US005752566A

United States Patent [19]

Liu et al.

[11] Patent Number: 5,752,566

[45] Date of Patent: May 19, 1998

[54] HIGH CAPACITY CONDENSER

[75] Inventors: Qun Liu, Grosse Ile; Rebecca McNally Gilden, Ypsilanti; Jeffrey Paul Luther, Ann Arbor, all of Mich.

[73] Assignee: Ford Motor Company, Dearborn, Mich.

[21] Appl. No.: 784,881

[22] Filed: Jan. 16, 1997

[51] Int. Cl.[6] ..... F28B 1/00

[52] U.S. Cl. ..... 165/110; 165/144; 165/175

[58] Field of Search ..... 165/174, 144, 165/110, 111, 112, 175, DIG. 514, DIG. 512; 137/572, 571

[56] References Cited

U.S. PATENT DOCUMENTS

| | | | |
|---|---|---|---|
| 593,989 | 11/1897 | Davidson . | |
| 1,798,354 | 3/1931 | Ris . | |
| 2,110,430 | 8/1938 | Swanson . | |
| 2,184,657 | 12/1939 | Young . | |
| 2,310,234 | 2/1943 | Haug . | |
| 2,505,790 | 5/1950 | Panthofer . | |
| 2,833,121 | 5/1958 | Dorf . | |
| 3,450,197 | 6/1969 | Fieni | 165/174 |
| 3,587,730 | 6/1971 | Milton . | |
| 3,675,710 | 7/1972 | Ristow . | |
| 3,759,319 | 9/1973 | Ritland et al. . | |
| 3,802,496 | 4/1974 | Ris et al. . | |
| 3,807,494 | 4/1974 | Ris . | |
| 3,989,103 | 11/1976 | Cieszko et al. | 165/110 |
| 4,141,409 | 2/1979 | Woodhull, Jr., et al. . | |
| 4,300,481 | 11/1981 | Fisk . | |
| 4,340,114 | 7/1982 | Levy . | |
| 4,443,188 | 4/1984 | Bühler . | |
| 4,573,526 | 3/1986 | Jung . | |
| 4,607,689 | 8/1986 | Mochida et al. . | |
| 4,724,904 | 2/1988 | Fletcher et al. . | |
| 4,794,983 | 1/1989 | Yoshida et al. . | |
| 4,972,683 | 11/1990 | Beatenbough . | |
| 5,095,972 | 3/1992 | Nakaguro | 165/175 |
| 5,141,048 | 8/1992 | Sausner . | |
| 5,159,821 | 11/1992 | Nakamura . | |
| 5,199,387 | 4/1993 | Ap . | |
| 5,203,407 | 4/1993 | Nagasaka . | |
| 5,341,870 | 8/1994 | Hughes et al. | 165/110 |
| 5,509,466 | 4/1996 | McQuade et al. . | |

FOREIGN PATENT DOCUMENTS

| | | |
|---|---|---|
| 1244260 | 9/1989 | Japan . |
| 2259378 | 10/1990 | Japan . |
| 370951 | 3/1991 | Japan . |
| 4174296 | 6/1992 | Japan . |
| 4268128 | 9/1992 | Japan . |
| 16438 | 6/1927 | Netherlands . |
| 1048266 | 10/1989 | U.S.S.R. . |
| 17550 | 8/1906 | United Kingdom . |

*Primary Examiner*—John K. Ford
*Assistant Examiner*—Christopher Atkinson
*Attorney, Agent, or Firm*—Raymond L. Coppiellie, Esq.; Roger L. May, Esq.

[57] ABSTRACT

A heat exchanger acting as a condenser having a plurality of tubes for cooling a refrigerant flowing through the tubes to condense the vapor phase of the refrigerant to a liquid is shown wherein the condenser has a plurality of headers having baffles and/or phase separators positioned therein. The refrigerant strikes a side wall of one of the headers and respective phases are separated by gravity. Additionally, phase separators may be used to selectively route the vapor and liquid phases to specific locations in the heat exchanger. By-pass lines are used to transfer the non-productive phase to a specific location in the heat exchanger.

14 Claims, 4 Drawing Sheets

Fig-2
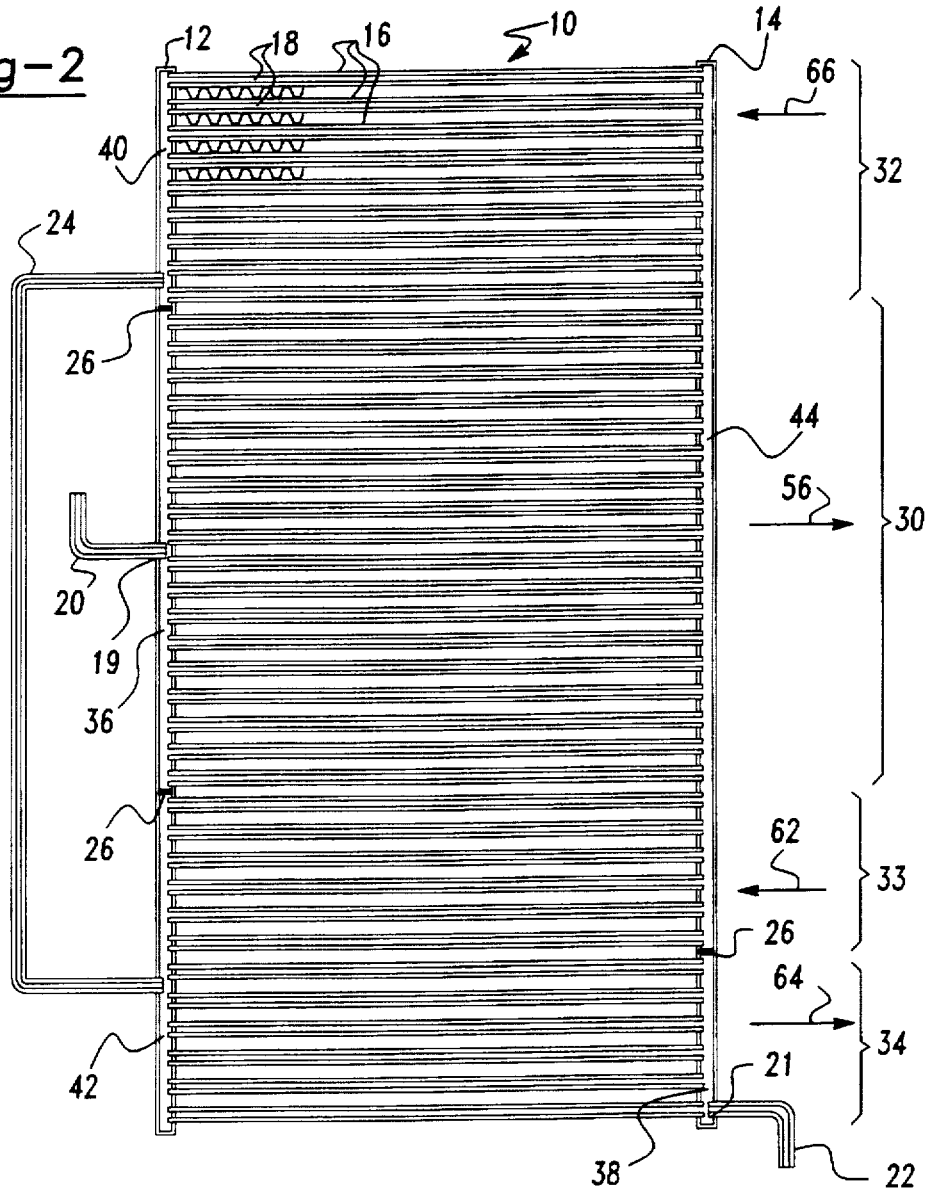
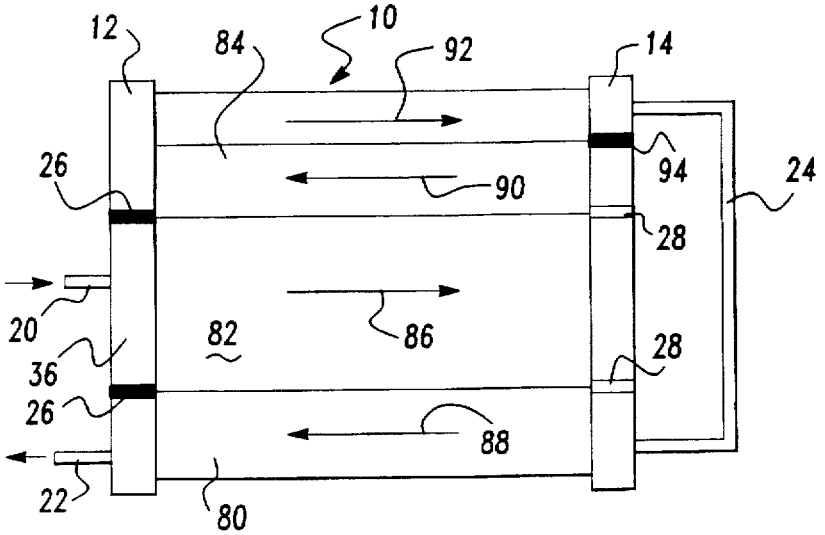
Fig-4

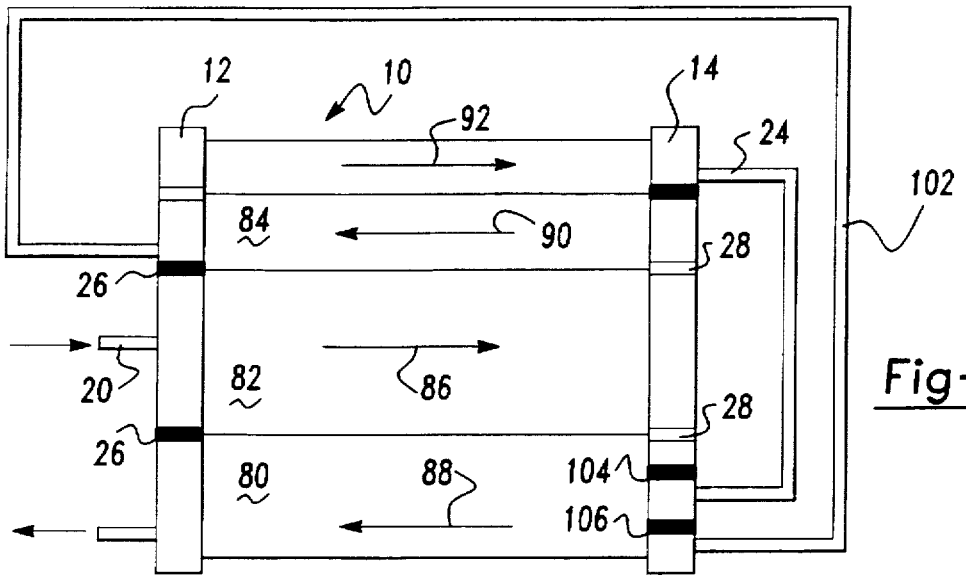
Fig-6
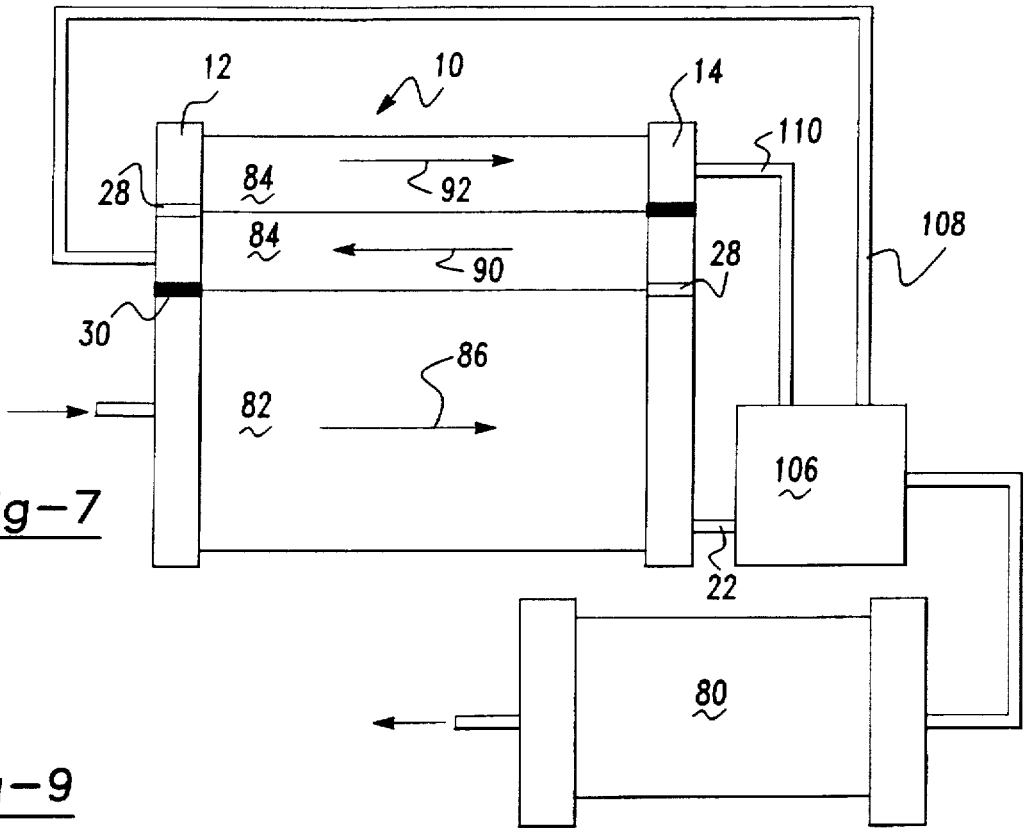
Fig-7
Fig-9
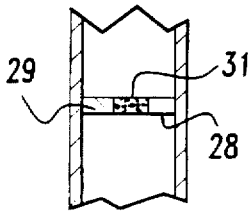
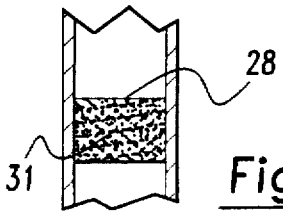
Fig-8
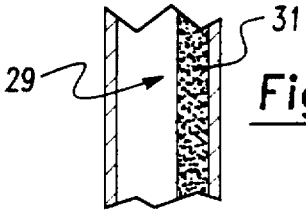
Fig-10

HIGH CAPACITY CONDENSER

BACKGROUND OF THE INVENTION

1. Field of the Invention

The present invention relates generally to a heat exchanger for use in a refrigeration/air conditioning system, and more specifically, to a condenser having multiple flow paths and preferential phase distribution.

2. Description of the Related Art

Condensers typically receive a refrigerant in a vapor phase, at a reasonably high temperature, and cool the vapor phase to transform it to a liquid phase. Condensers normally include a plurality of adjacent tubes extending between opposite headers. A plurality of cooling fins are disposed between the adjacent tubes. One type of condenser, often referred to as a multi-path condenser, includes a plurality of baffles placed in one or both of the headers to direct the refrigerant through a plurality of flow paths. As the refrigerant flows in a back and forth pattern through the condenser, heat is transferred from the vapor phase of the refrigerant through the tubes and fins causing the refrigerant to condense to a liquid phase. The liquid phase continues to flow through the tubes of the condenser until it reaches the outlet where it is drawn off and used in the refrigeration/air conditioning system. Continued flow of the liquid phase through the tubes decreases the overall efficiency of the condenser as the vapor phase is hindered from contacting and transferring heat to the tubes. Further, the liquid phase of the refrigerant occupies space within the tubes, thus reducing available interior surface area for heat transfer.

Therefore, it is advantageous to remove or reduce the non-productive phase; i.e., the liquid phase of the refrigerant in a condenser, from subsequent condensing paths of the heat exchanger. Removal of the liquid phase ensures that the heat exchanger, or in this case the condenser, operates at peak efficiency by maintaining a higher quality vapor-rich phase flow through the heat exchanger. As efficiency is increased, a lower number of tube/fin paths are required to transform the vapor phase to a liquid phase. Alternatively, a condenser of similar or same size would provide improved condensing capacity.

SUMMARY OF THE INVENTION

Accordingly, the present invention is a heat exchanger for maintaining a preferential phase distribution to remove or redirect the non-productive phase of a refrigerant from the heat transfer area of the heat exchanger. In the present invention, the heat exchanger is a condenser including a plurality of tubes extending parallel with and stacked on top of one another. The tubes are connected on opposite, lateral ends to individual headers. Fins are positioned between the tubes and help transfer the heat from the refrigerant as it flows through the condenser. Baffles are positioned within the headers to divide the headers into a plurality of chambers and the tubes into groups, each group defining a flow path. The refrigerant enters the condenser through an inlet positioned adjacent to an inlet chamber of the header. The refrigerant flows through the middle of the condenser and upon striking the opposite header, the refrigerant is separated by gravity into a vapor-rich phase that flows in one direction and a liquid-rich phase that flows in an opposite direction. Further, one or more phase separators can be positioned in the headers to assist in selectively routing specific phases of the refrigerant to specified flow paths.

A by-pass line interconnects individual chambers to transfer one phase of the refrigerant to a specific location or chamber of the condenser.

One advantage of the present invention is that the non-productive or liquid-rich phase of the refrigerant is routed through the by-pass line to a liquid-rich area of the condenser, either a sub-cooler or an outlet chamber of the header. A further advantage includes maintaining preferential phase distribution; i.e., the vapor-rich phase is routed to a large heat transfer area, while the liquid-rich phase is routed directly to the liquid-rich area of the condenser.

Directing the vapor-rich phases to a more efficient area of the condenser while removing the liquid phase increases the overall efficiency of the condenser. Increasing the efficiency reduces the number of flow paths required and correspondingly reduces the overall size of the condenser. Further, a condenser of similar size would provide improved condensing capacity.

Other features and advantages of the present invention will be readily appreciated as the same becomes better understood after reading the subsequent description taken in conjunction with the accompanying drawings.

BRIEF DESCRIPTION OF THE DRAWINGS

FIG. 2 is a sectional view of the condenser of FIG. 1 taken along lines 2—2.

FIG. 4 is a schematic view of another embodiment according to the present invention of the condenser of FIG. 1.

FIG. 6 is a schematic view of still another embodiment of the present invention.

FIG. 7 is a schematic view of another embodiment of the present invention.

FIG. 8 is an enlarged view of the area shown in circle 8—8 of FIG. 3.

FIG. 9 is another embodiment of the phase separator as illustrated in FIG. 3.

FIG. 10 is still another embodiment of a phase separator for use with the present invention.

DESCRIPTION OF THE PREFERRED EMBODIMENT(S)

Figure 1:
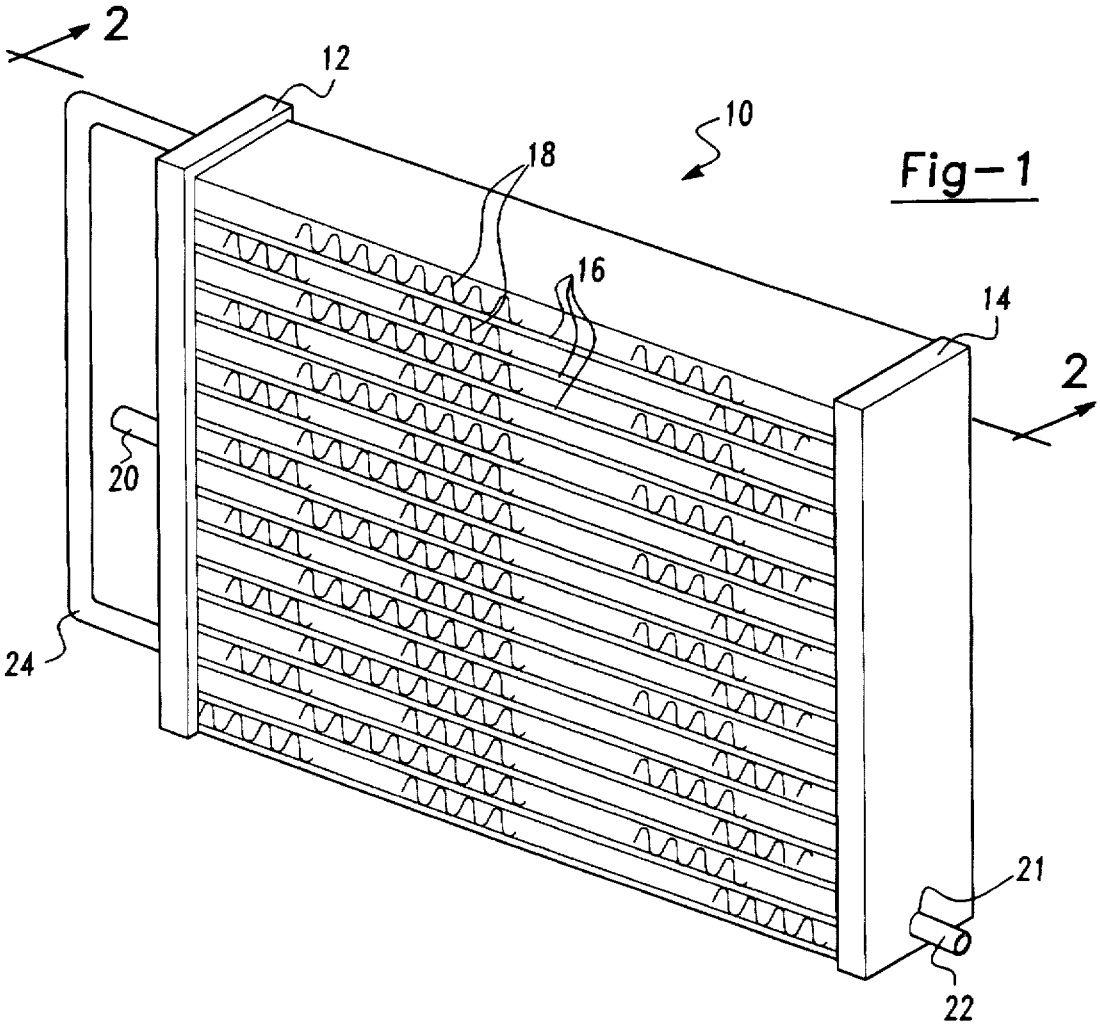
FIG. 1 is a perspective view of a condenser according to the present invention.

Referring now to FIGS. 1 and 2, there is shown a heat exchanger. As disclosed therein, the heat exchanger is a condenser 10 used to condense a refrigerant from a vapor-rich phase to a liquid-rich phase. The condenser 10 includes an inlet header 12 and an outlet header 14. A plurality of tubes 16 extend between the inlet and outlet headers 12, 14. The tubes 16 are sealed within the headers 12, 14 and provide for fluid communication between the respective headers 12, 14. A plurality of fins 18 for assisting in heat transfer are positioned between the respective tubes 16. Attached to the inlet header 12 via an opening 19 is a vapor inlet line 20. Attached through an opening 21 on the outlet header 14 is a liquid outlet line 22. A by-pass tube 24 is connected to the inlet header 12 for a purpose to be discussed later.

Turning now to FIG. 2, as shown therein, the inlet header 12 and outlet header 14 are hollow in shape. The inlet header 12 contains baffles 26. The baffles 26 define an inlet chamber 36 and upper and lower flow chambers 40 and 42, respectively. The outlet header 14 also includes a baffle 26 defining an outlet chamber 38 and a separating chamber 44.

The refrigerant enters the condenser 10 in a vapor phase through the vapor inlet line 20 and flows into the inlet chamber 36 of the inlet header 12. Baffles 26 prevent the refrigerant from flowing out of the inlet chamber 36 and thus the vapor phase is forced to flow through a middle or central group of tubes 30 defining a middle flow path in the direction of arrow 56. Upon reaching the separating chamber 44, the refrigerant strikes the separating chamber wall and is separated, by gravity, into a vapor-rich phase and a liquid-rich phase. The liquid-rich phase is routed through a first set of lower tubes 33 forming a flow path in the direction shown by arrow 62 to a lower group of tubes 34 forming a second lower flow path in a direction shown by arrow 64. The vapor-rich phase of the refrigerant is routed upward and flows through an upper group of tubes 32 forming an upper flow path in the direction of arrow 66. As the vapor-rich refrigerant travels through the upper group of tubes 32, it condenses. Upon reaching upper chamber 40, the condensed or liquid-rich phase of the refrigerant travels through the by-pass tube 24 to the lower chamber 42 of the condenser 10. Ultimately, the liquid-rich phase exiting the first group of lower tubes 33 travels along with the liquid exiting the liquid by-pass tube 24, through the second group of lower tubes 34 and empties into the outlet chamber 38. The liquid-rich phase of the refrigerant then exits the condenser 10 through the liquid outlet line 22.

It should be appreciated that removal or reduction of the non-productive phase is performed as a result of gravity separating the vapor-rich phase from the liquid-rich phase when the refrigerant exits the middle flow or central group of tubes 30 and enters the separating chamber 44 of the outlet header 14. Thus, as shown in FIG. 2, the phase distribution takes two distinct flow paths wherein the lower flow path is liquid-rich while the upper flow path is vapor rich.

Figure 3:
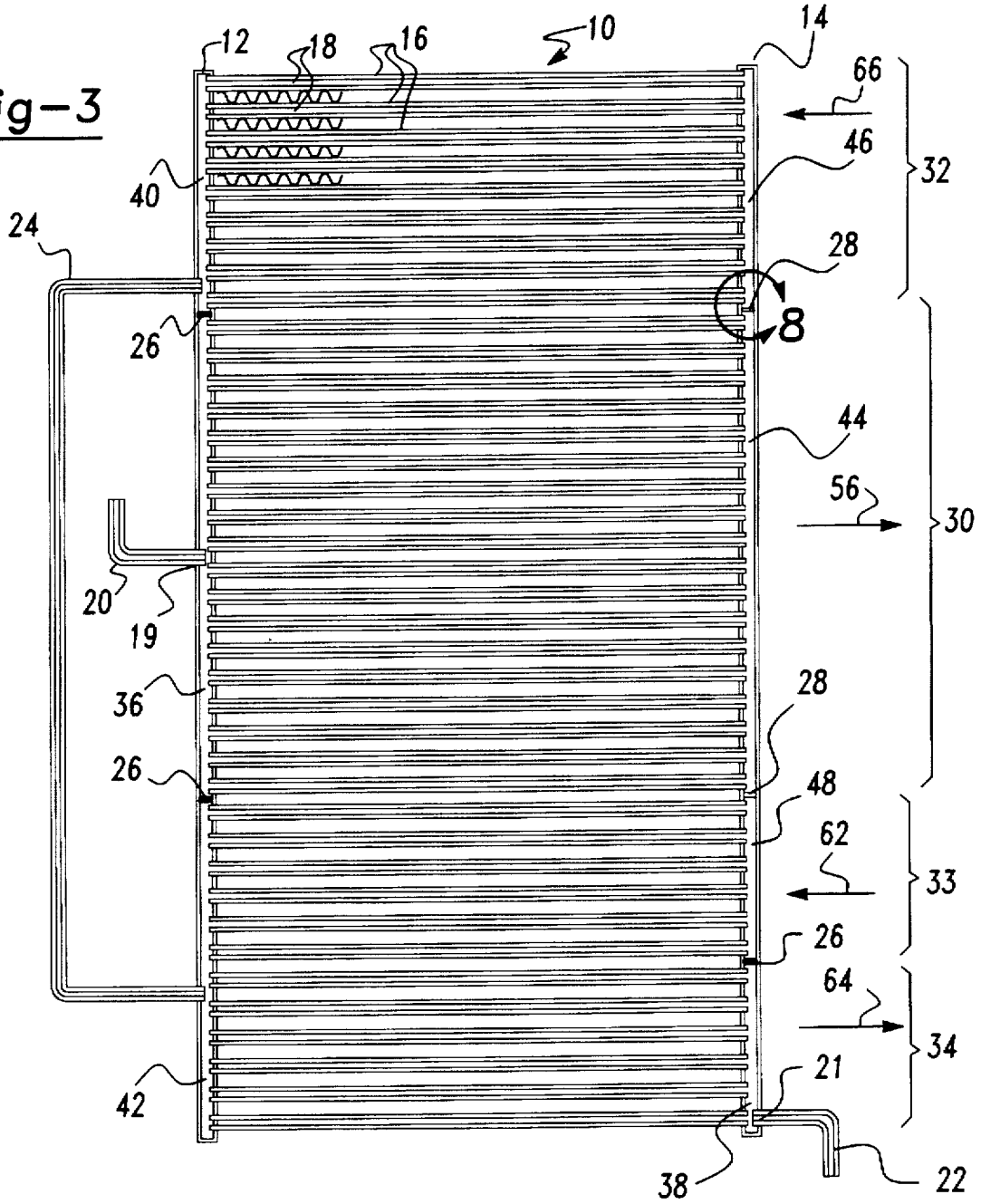
FIG. 3 is a sectional view of the condenser of FIG. 1 including phase separators.

Turning now to FIG. 3, a further embodiment of the condenser 10 is shown. Like parts have like numerals. As shown in FIG. 3, the outlet header 14 includes a plurality of phase separators 28. The phase separators 28 divide the separating chamber 44 into two additional chamber portions, an upper portion 46 and a lower portion 48. As previously set forth, the refrigerant flows through the middle or central group of tubes 30, in the direction shown by arrow 56. As the refrigerant fills the separating chamber 44, it contacts the phase separators 28 which selectively routes the non-productive or liquid-rich phase downward into the lower portion 48 of the separating chamber 44, and the vapor-rich phase upward to the upper portion 46 of the separating chamber 44. It should be appreciated that the phase separators 28 act to reduce or remove the non-productive phase from the heat transfer areas of the condenser 10. While shown as similar, the phase separators 28 can be of different types; i.e., the lower phase separator typically provides greater permeability to the liquid-rich phase while resisting flow of the vapor-rich phase.

Turning now to FIGS. 8–10, phase separators 28 according to the present invention are shown. FIG. 8 illustrates a phase separator 28 made of a porous media 31; i.e., a heterogeneous material made of a solid matrix with communicating voids. Examples would include metals such as powder or pressed aluminum, styrene and polymers, including sponges and foams, and rock or minerals. Depending upon the design of the phase separator 28, it may allow flow of a vapor-rich phase of the refrigerant while reducing or preventing flow therethrough of a liquid-rich phase. As shown in FIG. 9, the phase separator 28 includes a flat plate 29 having a center portion formed of a porous media 31. FIG. 10 illustrates a phase separator 29 formed of a porous media 31 deposited along the side wall of a tube or header. In use, the porous media is deposited along the sidewall of the separating chamber 44 such that the refrigerant exiting the middle group of tubes 30 strikes the porous media 31 and is separated by gravity. Other phase separators, such as plate-like members having an orifice therein, or screens contained in an orifice can be used to permit vapor phase flow, but reduce liquid phase flow.

FIG. 4 shows another embodiment of a heat exchanger used as a condenser 10. Again, like parts have like numerals. The condenser 10 includes a sub-cooling section 80, a desuperheating section 82 and a vapor-rich condensing section 84. As shown in FIG. 4, the refrigerant enters through the vapor inlet line 20 into inlet chamber 36 defined in the inlet header 12 by baffles 26. The fluid flows through the desuperheating section 82 in the direction shown by arrow 86. Upon striking the outlet header 14, the refrigerant is selectively routed by gravity based upon its phase to specific locations in the condenser 10. Phase separation can be furthered by use of the phase separators 28. The liquid-rich or non-productive phase of the refrigerant is directed to the sub-cooling section 80 and flows in the direction shown by arrow 88 towards and ultimately out of the inlet header 12 through liquid outlet line 22. The vapor-rich phase of the refrigerant is directed through the phase separator 28 into the vapor-rich condensing section 84 and flows in two paths 90, 92 defined by an additional baffle 94. The vapor-rich phase is then condensed via the vapor-rich condensing section 84 and flows through the by-pass tube 24 to the sub-cooling section 80.

Figure 5:
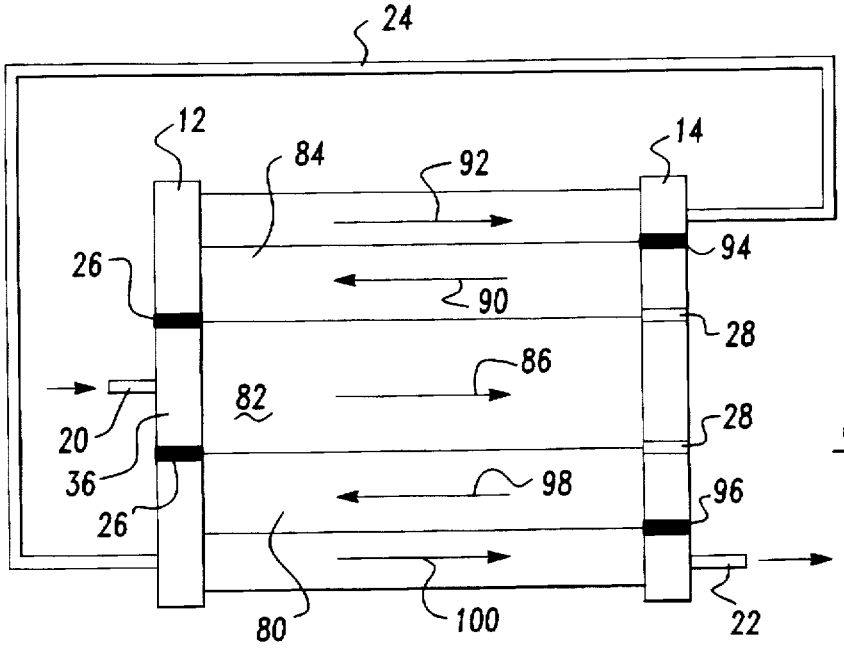
FIG. 5 is a schematic view of yet another embodiment according to the present invention of the condenser of FIG. 1.

FIG. 5 shows yet another embodiment of a condenser 10 according to the present invention. Again, the condenser 10 includes a sub-cooling section 80, a desuperheating section 82 and a vapor-rich condensing section 84. The outlet header 14 further includes an additional baffle 96 dividing the sub-cooling section 80 into two flow paths as shown by arrows 98, 100. Additionally, the by-pass tube 24 extends from the upper portion of the outlet header 14 to the lower portion of the inlet header 12.

FIG. 6 is still another embodiment of a condenser according to the present invention. As shown in FIG. 6, an additional by-pass line 102 draws the liquid-rich phase from the vapor-rich condensing section 84 after the refrigerant completes a first pass in the direction shown by arrow 90 through the vapor-rich condensing section 84. Additional baffles 104, 106 further separate the liquid-rich phase flow received from the vapor-rich condensing section 84. It should be appreciated that removing the non-productive or liquid-rich phase of the refrigerant increases the overall efficiency of the condenser 10.

Turning now to FIG. 7, there is shown another embodiment according to the present invention. As shown therein, the sub-cooling section 80 is placed separate from the condenser 10 wherein a receiver/dryer 106 receives the liquid-rich phase of the refrigerant as it exits from the condenser 10 through by-pass lines 108, 110 and from outlet line 22. Once again, a plurality of baffles 36 and a phase separator 28 are used to direct the flow and separate the vapor-rich and liquid-rich phases of the refrigerant for optimum use of the condenser 10.

It should be appreciated that the phase separation occurs primarily as a result of the refrigerant striking the sidewall of the separating chamber 44 and gravity acting on the liquid-rich phase. It should be noted that the particular number of tubes illustrated in FIG. 2 is representative only. The numbers set forth in the various flow paths are determined on the basis of design parameters and the liquid to be condensed for the particular application.

While shown here as only a single vertical row of tubes, any desired number of rows may be used. Additionally, in some instances it may be necessary to increase the amount of flow paths to condense the refrigerant from the vapor phase to a liquid phase, and the addition of multiple passes and multiple by-pass lines for transporting the liquid phase from the multiple flow paths are contemplated.

The present invention has been described in an illustrative manner. It is to be understood that the terminology which has been used is intended to be in the nature of words of description rather than of limitation.

Many modifications and variation of the present invention are possible in light of the above teachings. Therefore, within the scope of the appended claims, the present invention may be practiced other than as specifically described.

What is claimed is:

1. A condenser comprising:

a plurality of tubes connected on opposite ends to inlet and outlet headers, wherein a refrigerant enters said condenser through an inlet line in a vapor phase and passes through a portion of said plurality of tubes and exits said condenser through an outlet line in a liquid phase, said inlet header including a plurality of baffles forming an inlet chamber, an upper chamber and a lower chamber in said inlet header; and a by-pass line interconnecting said upper chamber with said lower chamber wherein said inlet chamber is positioned between said upper chamber and said lower chamber.

2. A condenser as set forth in claim 1 wherein said plurality of tubes includes a middle group of tubes associated with said inlet chamber, said refrigerant entering said inlet chamber flows through said middle group of tubes and enters said outlet header, said outlet header separating said refrigerant into a liquid-rich phase and a vapor-rich phase, said vapor-rich phase routed upward to an upper group of tubes and said liquid-rich phase routed downward to a lower group of tubes.

3. A condenser as set forth in claim 1 wherein said outlet header includes a plurality of phase separators, said phase separators routing said vapor-rich phase of the refrigerant in one direction and said liquid-rich phase of the refrigerant in a second direction.

4. A condenser as set forth in claim 3 wherein said phase separators are formed of a porous media.

5. A condenser as set forth in claim 2 including said baffles combined with said headers to define a plurality of refrigerant flow paths, and a plurality of by-pass lines interconnecting said plurality of flow paths.

6. A condenser as set forth in claim 2 including a phase separator positioned in said outlet header, said phase separator routing the flow of said vapor-rich phase of said refrigerant to said upper group of tubes and said liquid-rich phase of said refrigerant to said lower group of tubes.

7. A condenser comprising:

a plurality of tubes connected on opposite, lateral ends to an inlet and outlet header;

a plurality of baffles positioned within said inlet and outlet headers to divide each header into a plurality of chambers, said chambers cooperating with said tubes to form a plurality of refrigerant flow paths, each flow path having a plurality of tubes associated therewith, said plurality of refrigerant flow paths including a middle group of tubes associated with an inlet chamber, said refrigerant entering said condenser at said inlet chamber and flowing first through said middle group of tubes, said outlet header receiving the refrigerant exiting said middle group of tubes and routing a vapor-rich phase of said refrigerant to an upper group of tubes associated with an upper chamber of said inlet header and routing a liquid-rich phase to a lower group of tubes associated with a lower chamber in said inlet header; and a by-pass line interconnecting said upper and lower chambers, said by-pass line forming a fluid path for transporting a liquid-rich phase of said refrigerant between said chambers.

8. A condenser as set forth in claim 7 including a phase separator positioned within said outlet header, said phase separator routing said liquid-rich phase and said vapor-rich phase of the refrigerant to specific locations in the condenser.

9. A condenser as set forth in claim 8 wherein said phase separator includes a porous media.

10. A condenser as set forth in claim 8 including a plurality of by-pass lines interconnecting said plurality of chambers to allow said liquid-rich phase to by-pass at least one of said flow paths.

11. A condenser as set forth in claim 8 wherein said phase separator routes said vapor-rich phase of said refrigerant to an upper group of tubes and said liquid-rich phase of said refrigerant to a lower group of tubes.

12. A condenser comprising:

a plurality of tubes connected at opposite, lateral ends to an inlet and outlet header, said tubes divided into a plurality of tube groups setting forth multiple flow paths wherein a refrigerant flows through said tube groups in a back and forth direction;

a plurality of baffles placed in said inlet header to define the flow paths such that a middle flow path is defined by an inlet chamber and a middle group of tubes associated therewith, said middle group of tubes terminating in said outlet header; and a plurality of phase separators positioned within said outlet header and associated with said middle flow path, said phase separators forming an upper and lower boundary in said outlet header for said middle flow path, said phase separators selectively routing a vapor-rich phase of said refrigerant and a liquid-rich phase of said refrigerant to specific locations in said condenser, said condenser further including said middle flow path forming a desuperheating path, an upper flow path forming a vapor-rich phase flow path and a lower flow path forming a liquid-rich phase flow path, said phase separator selectively routing said vapor-rich phase to said vapor-rich flow path and said liquid-rich phase to said liquid-rich flow path wherein said lower flow path is positioned below said desuperheating flow path and said upper flow path is positioned above said middle flow path; and a by-pass line interconnecting said upper flow path with said lower flow path.

13. A condenser as set forth in claim 12 wherein said upper flow path includes a plurality of by-pass lines interconnecting said upper flow path with said lower flow path.

14. A condenser as set forth in claim 13 wherein said phase separators are formed of a porous media.

* * * * *